US011286746B2

(12) United States Patent
Ross et al.

(10) Patent No.: US 11,286,746 B2
(45) Date of Patent: Mar. 29, 2022

(54) WELL IN A GEOLOGICAL STRUCTURE

(71) Applicant: METROL TECHNOLOGY LIMITED, Aberdeen (GB)

(72) Inventors: Shaun Compton Ross, Aberdeen (GB); Leslie David Jarvis, Aberdeen (GB)

(73) Assignee: METROL TECHNOLOGY LIMITED, Aberdeen (GB)

( * ) Notice: Subject to any disclaimer, the term of this patent is extended or adjusted under 35 U.S.C. 154(b) by 8 days.

(21) Appl. No.: 16/647,590

(22) PCT Filed: Sep. 18, 2018

(86) PCT No.: PCT/GB2018/052659

§ 371 (c)(1),
(2) Date: Mar. 16, 2020

(87) PCT Pub. No.: WO2019/063973

PCT Pub. Date: Apr. 4, 2019

(65) Prior Publication Data

US 2021/0040817 A1 Feb. 11, 2021

(30) Foreign Application Priority Data

Sep. 26, 2017 (GB) ..... 1715585

(51) Int. Cl.
*E21B 34/06* (2006.01)
*E21B 47/13* (2012.01)
(Continued)

(52) U.S. Cl.
CPC ..... *E21B 34/066* (2013.01); *E21B 47/13* (2020.05); *E21B 47/14* (2013.01); *E21B 21/12* (2013.01)

(58) Field of Classification Search
CPC ..... E21B 34/066; E21B 43/12; E21B 47/13; E21B 47/14; E21B 21/12
See application file for complete search history.

(56) References Cited

U.S. PATENT DOCUMENTS 2,298,834 A * 10/1942 Moore ..... E21B 43/122 166/54.1
4,364,232 A 12/1982 Sheinbaum
(Continued)

FOREIGN PATENT DOCUMENTS

EP 3309356 A1 * 4/2018 ..... E21B 47/13
GB 2109895 A * 6/1983 ..... E21B 34/10
(Continued)

OTHER PUBLICATIONS

International Search Report for PCT/GB2018/052659, dated Dec. 10, 2018.
(Continued)

*Primary Examiner* — Jennifer H Gay
(74) *Attorney, Agent, or Firm* — Womble Bond Dickinson (US) LLP

(57) ABSTRACT

A well (10) in a geological structure, the well (10) comprising a first casing string (12*a*) with a second casing string (12*b*) partially inside, and a third casing string (13*c*) partially inside the second casing string (12*b*). A first inter-casing annulus (14*a*) is defined between the first (12*a*) and second casing strings (12*b*), and a second inter-casing annulus (14*b*) is defined between the second (12*b*) and third casing strings (12*c*). A primary fluid flow control device (16*a*), such as a wirelessly controllable valve, on the second casing provides (12*b*) fluid communication between the first inter-casing annulus (14*a*) and the second inter-casing annulus (14*b*); and a secondary fluid flow control device (16*b*), such as a second wirelessly controllable valve, on the third casing string (12*c*) provides fluid communication between the second inter-casing annulus (14*b*) and a bore of the third casing (14*c*). In the event of a "blow-out", a kill fluid can then be introduced into an annulus and the fluid flow control devices used to allow the kill fluid to cascade down the well to control it. Accordingly, the time taken to drill a relief well
(Continued)

Figure 1:
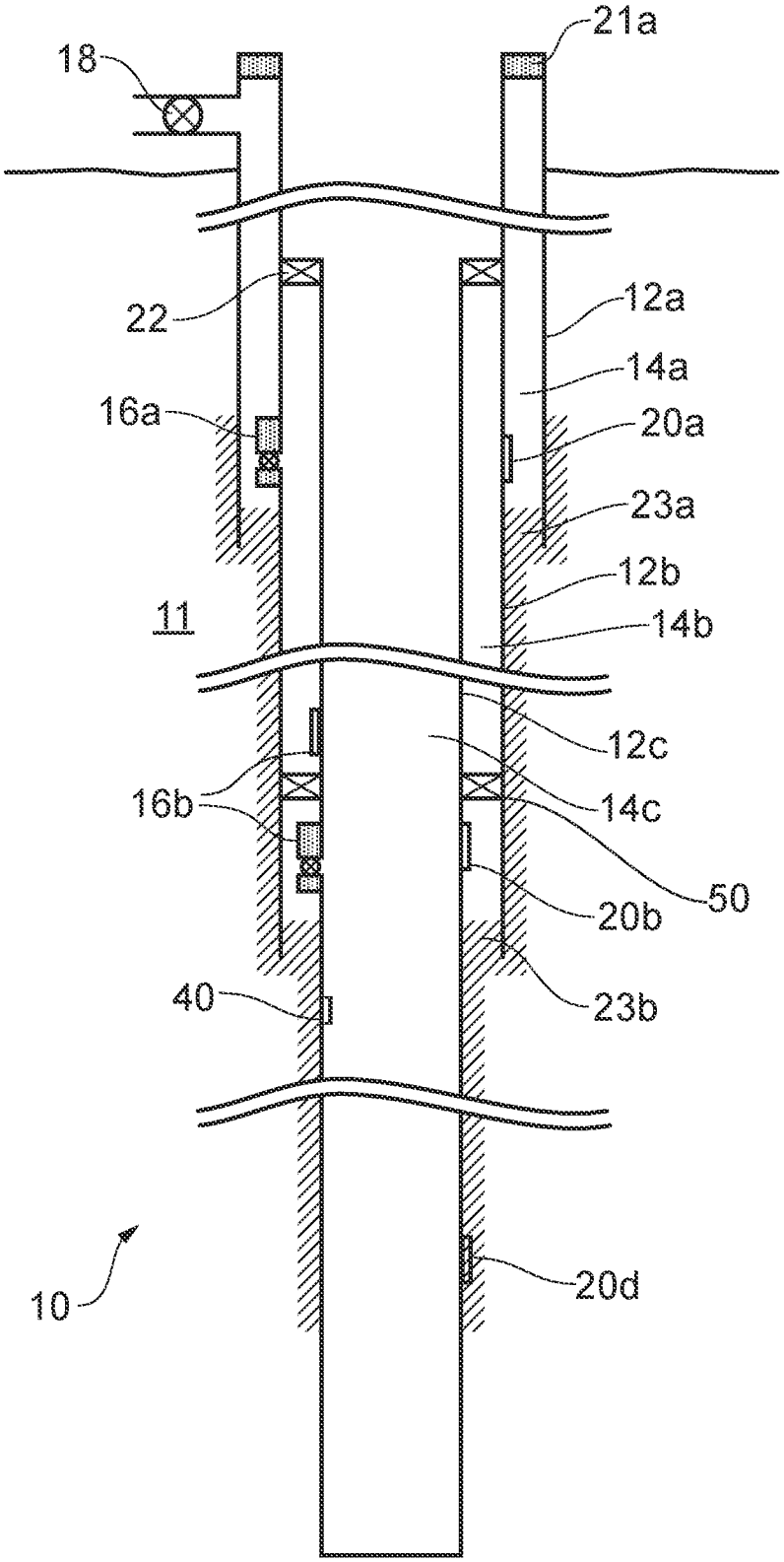

may be mitigated or obviated which can reduce the time and cost to control the well and can mitigate environmental impact of hydrocarbon loss caused by the blow-out.

28 Claims, 2 Drawing Sheets

(51) Int. Cl.
*E21B 47/14* (2006.01)
*E21B 21/12* (2006.01)

(56) References Cited

U.S. PATENT DOCUMENTS 6,293,346 B1 9/2001 Patel
7,191,830 B2 * 3/2007 McVay ..... E21B 17/1078 166/242.1
8,579,032 B2 * 11/2013 Fenton ..... E21B 34/08 166/321
9,359,859 B2 * 6/2016 Ross ..... E21B 23/00
9,410,420 B2 * 8/2016 Ross ..... E21B 47/12
9,714,552 B2 * 7/2017 Ross ..... E21B 47/06
9,945,204 B2 * 4/2018 Ross ..... E21B 34/12
10,030,466 B2 * 7/2018 Ross ..... E21B 47/06
10,113,410 B2 * 10/2018 Stephens ..... E21B 33/035
2001/0027865 A1 * 10/2001 Wester ..... E21B 47/001 166/250.01
2003/0145999 A1 8/2003 Gatherar et al.
2005/0189107 A1 * 9/2005 McVay ..... E21B 41/00 166/242.1
2006/0196539 A1 * 9/2006 Raska ..... E21B 34/063 137/68.24
2013/0175094 A1 * 7/2013 Ross ..... E21B 23/06 175/57
2013/0180726 A1 * 7/2013 Ross ..... E21B 47/14 166/336
2015/0240592 A1 * 8/2015 Ross ..... E21B 34/066 166/363
2015/0240597 A1 * 8/2015 Ross ..... E21B 34/16 166/66.7
2015/0247373 A1 * 9/2015 Ross ..... E21B 34/16 166/387
2015/0292321 A1 * 10/2015 Keller ..... E21B 47/01 367/81
2016/0053542 A1 2/2016 Stafford
2020/0224514 A1 * 7/2020 Ross ..... E21B 34/063
2020/0277830 A1 * 9/2020 Ross ..... E21B 21/08
2021/0040817 A1 * 2/2021 Ross ..... E21B 47/13

FOREIGN PATENT DOCUMENTS

GB 2311312 A * 9/1997 ..... E21B 34/06
GB 2475409 A * 5/2011 ..... E21B 34/08
WO 2002084067 10/2002
WO 2004079240 9/2004
WO 2011067372 6/2011
WO 2016057014 4/2016
WO 2017027978 2/2017
WO 2019063972 4/2019
WO 2019063974 4/2019

OTHER PUBLICATIONS

Mingge HE et al, "A New Completion Hardware: Intelligent Casing Sleeve Based on Electromagnetic Wireless Communication", Society of Petroleum Engineers, SPE-181794-MS, 2016.
Mikolaj Ralowski, "Design of a hypothetical relief well for a shallow reservoir, possible challenges.", University of Stavanger, May 30, 2016, pp. 15-32.
UKIPO Combined Search and Examination Report for GB Application No. 1715585.4, dated Feb. 9, 2018.
Examination Report for GCC Application No. 2018/36075, dated Jan. 28, 2020.
TCO, Annulus Pressure Relief System Animation, Jan. 1, 2017 (screenshots) Available at https://vimeo.com/178325327.
Examination Report for Corresponding Gulf Cooperation Application No. 2018/36075, dated Nov. 10, 2020.
Examination Report for Corresponding Eurasian Application No. 202090692, dated Nov. 2, 2020.

* cited by examiner

WELL IN A GEOLOGICAL STRUCTURE

CROSS REFERENCE TO RELATED APPLICATIONS

This application is a 35 U.S.C. 371 National Stage of International Application No. PCT/GB2018/052659, titled "A WELL IN A GEOLOGICAL STRUCTURE", filed Sep. 18, 2018, which claims priority to GB Application No. 1715585.4, titled "A WELL IN A GEOLOGICAL STRUCTURE", filed Sep. 26, 2017, all of which are incorporated by reference herein in their entirety.

FIELD OF THE INVENTION

This invention relates to a well in a geological structure.

BACKGROUND

The drilling of boreholes, particularly for hydrocarbon wells, is a complex and expensive exercise. Reservoir conditions and characteristics need to be considered and evaluated constantly during all phases of the well's life so that it is designed and positioned to recover hydrocarbons as safely and efficiently as possible.

A borehole having a first diameter is initially drilled out to a certain depth and a casing string run into the borehole. A lower portion of the resulting annulus between the casing string and borehole is then normally cemented to secure and seal the casing string. The borehole is normally extended to further depths by continued drilling below the cased borehole at a lesser diameter compared to the first diameter, and the deeper boreholes then cased and cemented. The result is a borehole having a number of generally nested tubular casing strings which progressively reduce in diameter towards the lower end of the overall borehole.

As technology has advanced, and the understanding of borehole geometry and hydrocarbon geology has improved, companies have been able to extend the potential areas for finding and producing from downhole reservoirs. For example, in recent years hydrocarbons have been recovered from offshore subsea wells in very deep water, of the order of over 1 km. This poses many technical problems in drilling, securing, extracting, suspending and abandoning wells at such depths.

In a subsea environment a Blow-Out-Preventer (BOP) is connected to the drilling rig by way of a marine riser. Drill pipe can be lowered down through one or more of the marine riser, through the BOP, into a wellhead, and then down into the well to drill deeper into the ground. As drilling fluid or mud is pumped through the drill pipe and out through the drill bit, it circulates all the way around up through the marine riser back to the surface facility.

As the drill bit continues to make its way towards the hydrocarbons or 'pay zone', the drilling company closely monitors the amount of drilling fluid in storage tanks as well as the pressure of the formation(s) to ensure that the well is not experiencing a blow-out or 'kick'.

Drilling fluid can be much heavier than sea water, in some cases more than twice as heavy. This is helpful when drilling a well because its weight creates enough head pressure to keep any pressure in the hydrocarbon formation(s) from escaping back up through the well. The heavier the drilling fluid used when drilling a well, the less likely it is that formation pressure escapes back up into the well and up the marine riser. On the other hand, if the drilling fluid used whilst drilling is too heavy, there is a risk of losing fluid to the well and/or loosing well control. When this happens the drilling fluid begins leaking out into the underground formation(s). This is an issue because without being able to circulate the drilling fluid back to the surface, it will not be possible to drill any deeper. Moreover, when drilling fluid is lost there will be less drilling fluid in the fluid column above the drill bit, thus reducing its hydrostatic pressure, and possibly resulting in a 'kick' or blow-out from the well. As the well is drilled deeper and deeper, the drilling fluid weight operating window gets smaller and smaller and the potential for a kick/blow-out/loss of well control situation occurring increases.

In the event of a failure in the integrity of a subsea well, wellhead control systems are known to shut the well off to prevent a dangerous blow-out, or significant hydrocarbon loss from the well. The BOP can be activated from a control room to shut the well. Should this fail, a remotely operated vehicle (ROV) can directly activate the BOP at the seabed to shut the well.

In a completed well, rather than a BOP, a Christmas Tree is provided at the top of the well and a subsurface safety valve (SSSV) is normally added downhole. The SSSV is normally near the top of the well. The SSSV is normally activated to close and shut the well if it loses communication with the controlling platform, rig or vessel. A wellhead may comprise a BOP or a Christmas tree.

Despite these known safety controls, accidents still occur and a blow-out from a well can cause an explosion resulting in loss of life, loss of the rig and a significant and sustained escape of hydrocarbons into the surrounding area, threatening workers, wildlife and marine and/or land based industries. Blow-outs can also occur downhole in the formations and possibly cause a rupture in the earth's surface away from the well, which are particularly difficult to deal with. The well in the geological structure may be any offshore or land based well.

In the event of a major failure in the integrity of a well, a relief well has traditionally been drilled to intersect and control the well but drilling takes time and the longer it takes, the more hydrocarbons and/or drilling/well fluids are typically released into the environment.

SUMMARY

An object of the present invention is to mitigate problems with the prior art, and provide a well controllable by alternative means.

According to a first aspect of the present invention, there is provided a well in a geological structure, the well comprising:

- a first, a second and a third casing string, the second casing string at least partially inside the first casing string, the third casing string at least partially inside the second casing string;
- the first and second casing strings defining a first inter-casing annulus therebetween, the second and third casing strings defining a second inter-casing annulus therebetween, the third casing string defining a third casing bore therewithin;
- a primary fluid flow control device in the second casing string to provide fluid communication between the first inter-casing annulus and the second inter-casing annulus; and
- a secondary fluid flow control device in the third casing string to provide fluid communication between the second inter-casing annulus and the third casing bore.

Wherein in an open position, the primary fluid flow control device typically has a cross-sectional fluid flow area of at least 100 $mm^2$, normally at least 200 $mm^2$, and may be at least 400 $mm^2$. In an open position the secondary fluid flow control device typically has a cross-sectional fluid flow area of at least 100 $mm^2$, normally at least 200 $mm^2$, and may be at least 400 $mm^2$.

The primary and/or secondary fluid flow control device may comprise a plurality of apertures, the plurality of apertures having a total cross-sectional fluid flow area of at least 100 $mm^2$, normally at least 200 $mm^2$, and may be at least 400 $mm^2$.

It may be an advantage of the present invention that the primary and secondary fluid flow control device provides adequate and/or sufficient fluid flow between the first and second inter-casing annulus and/or between the second inter-casing annulus and the third casing bore to help control the well, for example in the event of a failure in the integrity of the well, such as kick or a blow-out, and/or significant hydrocarbon loss from the well.

Casing strings with valves are known but the valves are typically used for pressure equalisation. The inventors of the present invention have appreciated that the primary and secondary fluid flow control devices can be used to provide fluid communication between the first and second inter-casing annulus and the second inter-casing annulus and the third casing bore to control the well and/or control a well kick or blow-out, if the cross-sectional fluid flow area of the primary and secondary fluid flow control devices is adequate and/or sufficient and therefore of at least 100 $mm^2$, normally at least 200 $mm^2$, and may be at least 400 $mm^2$. This is not provided for by valves used for pressure equalisation.

In use, the primary fluid flow control device is opened and fluid is directed between the first inter-casing annulus and the second inter-casing annulus. In use, the secondary fluid flow control device is opened and fluid is directed between the second inter-casing annulus and the third casing bore. Before the primary and/or secondary fluid flow control device is opened, fluid communication between the first inter-casing annulus and the second inter-casing annulus and second inter-casing annulus and the third casing bore respectively is typically one or more of resisted, mitigated and prevented.

The second inter-casing annulus is also referred to as a second casing bore. The first inter-casing annulus may be referred to as the first casing bore.

The primary fluid flow control device in the second casing string is typically at least 100 meters below a top of the second casing string. The primary fluid flow control device in the second casing string is normally towards the bottom of the first casing string, which is typically within 500 meters, normally within 200 meters and may be within 100 meters of the bottom of the first casing string. The primary fluid flow control device in the second casing string is normally towards the bottom of an uncemented portion of the first inter-casing annulus, which is typically within 200 meters, normally within 100 meters and may be within 50 meters of the bottom of the uncemented portion of the first inter-casing annulus.

The secondary fluid flow control device in the third string is typically at least 100 meters below a top of the third casing string. The primary fluid flow control device in the second casing string is normally towards the bottom of the second casing string, which is typically within 500 meters, normally within 200 meters and may be within 100 meters of the bottom of the second casing string. The secondary fluid flow control device in the third casing string is normally towards the bottom of the uncemented portion of the second inter-casing annulus, which is typically within 200 meters, normally within 100 meters and may be within 50 meters of the bottom of the uncemented portion of the second inter-casing annulus.

The inter-casing annuli may not be cemented. Where an inter-casing annulus is not cemented, the bottom of the uncemented section of the inter-casing annulus is the bottom the outer-most casing of the inter-casing annulus.

The primary and/or secondary fluid flow control device is typically a valve. The valve normally comprises a check valve. The primary and/or secondary fluid flow control device typically comprises a rupture mechanism.

The valve of at least one of the primary and secondary fluid flow control devices is normally a wirelessly controlled valve. The valve of at least one of the primary and secondary fluid flow control devices is normally at least one of an acoustic signal, and electromagnetic and pressure-pulse wirelessly controlled valve.

The inventors of the present invention recognise that the wireless control of the valve allows the valve and/or the valve member of such embodiments to be movable between the different positions against the local pressure conditions in the well. This provides an advantage over check valves commonly used in conventional wells, wherein the corresponding movable elements move in response to the change in the local pressure conditions. Thus, unlike the wirelessly controllable valve of embodiments of the present invention, conventionally used check valves may not be moved against the local pressure conditions in the well. For certain embodiments, such a wirelessly controllable valve may be provided in addition to a check valve. The wireless control may especially be pressure pulsing, acoustic or electromagnetic control; more especially acoustic or electromagnetic control.

Indeed, it is considered that the skilled person may be deterred from adding a valve to a casing as potential leak path. However the use of a controllable valve for such embodiments ensures pressure integrity of the casing.

At least one, optionally each, flow control device may include a metal to metal seal. For example, a valve member and a valve seat may be made from metal, such as a nickel alloy.

The well may be an onshore well or an offshore and/or subsea well.

The well may further comprise one or more sensors at one or more of a face of the geological structure, in the well, in the first inter-casing annulus, in the second inter-casing annulus, in the third casing bore, in a well internal tubular, in a production tubing, in a completion tubing, and in a drill pipe.

The one or more sensors may be located internal or external to the well, first inter-casing annulus, second inter-casing annulus, third casing bore, well internal tubular, production tubing, completion tubing, and drill pipe. If external the one or more sensors may be ported and/or configured to read conditions internal.

The one or more sensors may sense a variety of parameters including but not limited to one or more of pressure, temperature, load, density and stress. Other optional sensors may sense, but are not necessarily limited to, the one or more of acceleration, vibration, torque, movement, motion, cement integrity, direction and/or inclination, various tubular/casing angles, corrosion and/or erosion, radiation, noise, magnetism, seismic movements, strains on tubular/casings including twisting, shearing, compression, expansion, buckling and any form of deformation, chemical and/or radioactive tracer detection, fluid identification such as hydrate, wax and/or sand production, and fluid properties such as, but not limited to, flow, water cut, pH and/or viscosity. The one or more sensors may be imaging, mapping and/or scanning devices such as, but not limited to, a camera, video, infrared, magnetic resonance, acoustic, ultra-sound, electrical, optical, impedance and capacitance. Furthermore the one or more sensors may be adapted to induce a signal or parameter detected, by the incorporation of suitable transmitters and mechanisms. The one or more sensors may sense the status of equipment within the well, for example a valve position or motor rotation.

Data from the one or more sensors may be used to one or more of optimise, analyse, assess, establish and manipulate properties of the fluid that is introduced into one or more of the first inter-casing annulus, the second inter-casing annulus, the third casing bore, and a well internal tubular.

The data from the one or more sensors may be used to one or more of optimise, analyse, assess, establish and manipulate properties of the fluid, and typically relies on data collected using the one or more sensors, that is then used and/or processed to suggest changes to the properties of fluid.

Data from the one or more sensors may be collected after the well has been controlled and/or killed to continue to monitor the well constantly or periodically for short or long term periods of days, weeks, months or years.

The one or more sensors are typically attached to one or more of the first, second and third casing string, a well internal tubular, a production tubing, a completion tubing, and a drill pipe. When the one or more sensors are attached they may be connected to one or more of the first, second and third casing string, a casing sub, a well internal tubular, a production tubing, a completion tubing, a drill pipe and/or in a wall of one or more of the first, second and third casing string, a casing sub, a well internal tubular, a production tubing, a completion tubing, and a drill pipe. There may be many suitable forms of connection and/or attachments.

One or more of the primary fluid flow control device, secondary fluid flow control device, one or more sensors, a battery and a transmitter, receiver or transceiver may be connected on or between a sub, carrier, pup joint, clamp and/or cross-over.

A bottom of any inter-casing annulus may be open or more typically may be closed by for example a packer or cement barrier.

The second inter-casing annulus is typically not ported at the top of the well.

The well may comprise two, or more, primary fluid flow control devices. The well may comprise two, or more, secondary fluid flow control devices. The two or more fluid flow control devices of a casing string may be longitudinally separated. At least one annular isolation device, such as a packer, may be provided between the two or more fluid flow control devices of a casing string. The at least one annular isolation device may be in any annulus. Thus an annulus may comprise multiple isolated sections which may be selectively linked to a further annulus via at least one fluid flow control device. The at least one annular sealing device may be wirelessly controllable and may be capable of selectively isolating or connecting the sections of the annulus. The at least one annular sealing device may be wirelessly settable and/or unsettable single or multiple times.

The third casing string may be a liner. The liner is typically casing string that does not extend to the top of the wellbore. The liner may not extend to the top of the wellbore, that is the top of the liner may be at least 100 meters below the top of the wellbore. The liner is conventionally suspended near the bottom of another casing string. The liner or casing string may extend all the way to the top of the well.

The well in the geological structure may be one or more of a water well, a well used for carbon dioxide sequestration, and gas storage well.

The geological structure typically comprises a reservoir that contains hydrocarbons. The well typically includes one or more communication paths providing fluid communication between the reservoir and the well. There is normally an uppermost communication path, that is a communication path that is closest to surface.

When we refer to the impermeable or at least substantially impermeable formation this is typically less permeable than a permeable formation there below. The permeable formation is typically a formation containing hydrocarbons. The permeable formation may be referred to as a reservoir. The permeable formation is typically therefore at least one of the formations that fluids are expected to flow naturally from. The fluids may be formation fluids. The fluids normally comprise hydrocarbons.

The communication path may be any fluid path between the formation or reservoir and the well. The one or more communication paths may be an annulus between the well and formation whilst or after drilling or can be perforations created in the well and surrounding formation by a perforating gun. In some cases use of a perforating gun to provide the one or more communication paths is not required. For example, the well may be open hole and/or it may include a screen/gravel pack, slotted sleeve or slotted liner or has previously been perforated.

The primary fluid flow control device may be within 1500 meters, typically within 1000 meters, normally within 500 meters and optionally within 100 meters of the uppermost communication path of the well.

The secondary fluid flow control device may be within 1500 meters, typically within 1000 meters, normally within 500 meters and optionally within 100 meters of the uppermost communication path of the well.

In use, a fluid may be introduced into the first inter-casing annulus; and opening the primary fluid flow control device, the fluid directed between the first and the second inter-casing annulus. In use, a fluid, typically the fluid, may be introduced into the second inter-casing annulus; and opening the secondary fluid flow control device, the fluid directed between the second inter-casing annulus and the third casing bore. Introducing the fluid may comprise pumping the fluid.

There are a number of reasons a well in a geological structure may be difficult to control or out of control or it may be difficult to proceed. If there is a well blow-out, it may not be possible to circulate or pump fluids into the well conventionally from the top of the well to control the well. Conventional methods of circulation may include using a well internal string and its outer annulus. The well of the present invention provides an alternative path to pump fluid into the well and/or circulate fluids in the well and thus control the well. If there is a blockage in the well preventing conventional circulation and/or pumping of fluids, the well of the present invention provides an alternative path to pump fluid into the well and/or circulate fluids in the well and thus control the well, for example to remove/dissolve the blockage.

If a drill string becomes stuck in a formation, for example because of 'bridging', it can traditionally be difficult to rectify, and this can cause an increase in well and/or back pressure below a bridge. Likewise, a blow-out or blockage in the well may mean that it is no longer possible to circulate fluid into the third casing bore or a well internal tubular, a production tubing, a completion tubing, and/or a drill pipe in the third casing bore. It may be an advantage of the present invention that using the well structure, fluid can be directed into the first inter-casing annulus, and then through the primary fluid flow control device into the second inter-casing, and then through the secondary fluid flow control device into the third casing bore to provide the necessary integrity to bring the well back under control. There is thereby the option to at least contain in part the pressure of fluid in the well. Normally a fluid flow control device below the bridge is used.

The fluid in the third casing bore, and other casing bore(s) if used, may be sufficient to gain more control over the well, by killing or at least partially killing it.

The well normally further comprises a fluid port in the first inter-casing annulus. The fluid port may be a well head port which may be at or adjacent a well head. The well head fluid port may be at surface for land wells or at the seabed for subsea wells. There may be more than one well head fluid port. A relief well and/or an interface between a relief well and the well and/or casing of the well may be referred to as a fluid port.

The fluid port may be in the side and/or wall of the first casing string. There may be a fluid port in the bottom of the first casing string. There may be two or more fluid ports in the first casing string.

In use, the fluid may be introduced into the first inter-casing annulus through the fluid port. The fluid may be introduced into the first inter-casing annulus at a wellhead at or adjacent or directly at the wellhead. This is particularly suitable for onshore and/or offshore platform wells where access to the first inter-casing annulus is more common.

Conventionally in a subsea completed well, fluid porting is not provided at the surface of the well to the outer annuli. According to the present invention, there may be a subsea well with fluid porting into the first inter-casing annulus. Conventionally, fluid ports are not provided into the annuli due to the complexities involved in a subsea completed well. Embodiments of the present invention provide an advantage that access to multiple annuli can be provided by a single fluid port at surface into an outer annuli.

An injection line may be attached to the wellhead to provide fluid communication with the first inter-casing annulus, such that the fluid may be introduced. This is often safer and/or easier than introducing the fluid into the first inter-casing annulus at the wellhead whilst the well is blowing out.

Alternatively, fluid may be introduced into the first inter casing annulus via the primary fluid flow control device and vented and/or produced via the fluid port.

The first inter-casing annulus is typically the so called 'C' annulus although it may be another annulus, especially an outer inter-casing annulus, depending on the circumstances of the well control/blow-out and the well construction and/or infrastructure.

The well may be used in a method of killing the well. Killing the well normally involves stopping flow of produced fluids up the well to surface. Killing the well may include balancing and/or reducing fluid pressure in the well to regain control of the well, and is not limited to stopping it from flowing or its ability to flow, though it may do so. The fluid may be, or may be referred to as, a kill fluid. The fluid is normally a drilling mud-type fluid but other fluids such as brine and cement may be used. Kill fluid is any fluid, sometimes referred to as kill weight fluid, which is used to provide hydrostatic head typically sufficient to overcome well, formation and/or reservoir pressure.

The first fluid flow control device is typically in an un-cemented section in the first inter-casing annulus between the first casing string and the second casing string. The second fluid flow control device is typically in an un-cemented section in the second inter-casing annulus between the second casing string and the third casing string.

The primary fluid flow control device in the second casing string may be in a wall of the second casing string. The primary fluid flow control device in the second casing string may be in or associated with a casing sub of the second casing string. The secondary fluid flow control device in the third casing string is typically in a wall of the third casing string. The secondary fluid flow control device in the third casing string may be in or associated with a casing sub of the third casing string.

The well may be a pre-existing well. The geological structure may be at least one geological structure of a plurality of geological structures. A pre-existing well may be any kind of borehole and is not limited to producing wells, thus the pre-existing well may be a borehole intended for injection, observational purposes, and economically unfeasible wells, even if they have not and/or will not in future be used to produce fluids.

Whilst typically associated with blow-out wells, the well of the present invention may be used for other purposes to carry out remedial action on a well or casing.

The second casing string typically has a diameter less than a diameter of the first casing string. The third casing string typically has a diameter less than a diameter of the second casing string.

The primary fluid flow control device may be one or more of a valve, casing valve and rupture mechanism.

The one or more sensors are typically used to measure at least one of pressure and density of the fluid in at least one of the first inter-casing annulus, second inter-casing annulus and third casing bore. At least one of pressure and density of the fluid in at least one of the first inter-casing annulus, second inter-casing annulus and third casing bore, may be measured before opening the primary fluid flow control device and directing the fluid from the first inter-casing annulus into the second inter-casing annulus and/or opening the secondary fluid flow control device and directing the fluid from the second inter-casing annulus into the third casing bore.

It may be an advantage of the present invention that by measuring at least one of pressure and density of the fluid in at least one of the first inter-casing annulus and second inter-casing annulus before opening the primary fluid flow control device, fluid can be safely moved around in the well with the confidence that opening the primary flow control device will result in the safe and/or controlled movement of the fluid between the first inter-casing annulus and the second casing bore. It may be an advantage of the present invention that by measuring at least one of pressure and density of the fluid in at least one of the second inter-casing annulus and third casing bore before opening the secondary fluid flow control device, fluid can be safely moved around in the well with the confidence that opening the secondary primary flow control device will result in the safe and/or controlled movement of the fluid between the second inter-casing annulus and the third casing bore.

In use, the primary flow control device is typically opened when the pressure of the fluid in the first inter-casing annulus is greater than the pressure of fluid in the second inter-casing annulus. In use, the secondary flow control device is typically opened when the pressure of the fluid in the second inter-casing annulus is greater than the pressure of fluid in the third casing bore.

Before the secondary fluid flow control device is opened, the primary fluid flow control device may be closed.

The third casing bore may contain one or more of a well internal tubular, a production tubing, a completion tubing, a drill pipe, a fluid flow control device, one or more sensors, one or more batteries and one or more transmitters, receivers or transceivers. The well internal tubular may be any one or more of a casing, liner, production tubing, completion tubing, well test tubing, drill pipe, injection tubular, observation tubular, abandonment tubular, and subs, cross overs, carriers, pup joints and clamps for the aforementioned.

One or more of the primary fluid flow control device, secondary fluid flow control device, one or more sensors, one or more batteries and one or more transmitters, receivers or transceivers may be connected on or between a sub, carrier, pup joint, clamp and/or cross-over.

The well may further comprise a plurality of casing strings and a plurality of inter-casing annuli. There is typically a plurality of fluid flow control devices to provide fluid communication between the annuli. The casing strings are typically nested with one casing string being at least partially inside another casing string.

The fluid flow control device(s) in one casing string can be the fluid port(s) in a different inter-casing annulus. When the fluid flow control device(s) in one casing string is the fluid port(s) in a different inter-casing annulus, the fluid port may be spaced away from the wellhead.

The fluid flow control device(s) can typically be opened and closed. Opening and/or closing the fluid flow control device may be referred to as activating the fluid flow control device. When the primary fluid flow control device is closed, fluid flow between the first inter-casing annulus and the second casing bore is restricted and may be stopped.

A communication system may be installed in the well. The communication system may comprise wireless communication and/or wireless signal(s). The communication system may be installed in the well and may in part be provided on a probe.

In use, data from the one or more sensors in the well may be recovered via the well. The data may help to determine or verify conditions in the well and on occasion be used to determine the location of a fluid leak and/or fluid path of a blow-out.

Data from the one or more sensors may be used to check the integrity of the first, second and/or third casing string before any fluid flow control device is opened. Checking the integrity of the first, second and/or third casing string may be used to assess the suitability of a method of fluid flow to control the well.

When the well has more than one inter-casing annulus, which is normal, the physical conditions in one inter-casing annulus of the well may be measured after, and normally also before, and whilst the fluid is being introduced into that inter-casing annulus and/or before fluid communication through the relevant casing string is allowed.

The integrity of the inter-casing annulus is typically assessed by conducting a pressure test. If a leak is detected, remedial action may be performed to inhibit the leak. Each further inter-casing annulus is normally similarly tested, progressing from outer to inner annuli. Thus, assuming each inter-casing annulus is assessed as being capable of withstanding the pressure applied to it, i.e. adequately but not necessarily absolutely sealed, this process is continued.

The fluid is typically eventually introduced into the part of the well where it is calculated and/or expected to control and/or kill the well, or where management of the well fluid is desired. This may be an outer inter-casing annulus but is often the innermost part of the well, for example a casing bore or tubing. The fluid used to kill the well may be a different fluid than that used to test the integrity of the inter-casing annulus. The fluid for testing could be circulated out of the well before the kill fluid is added. For example, a heavier fluid may be used to kill the well.

The well may have one or more of a perforating device, pyrotechnic device, explosive device, puncture device, rupture mechanism and valve in the first casing string, typically a wall of the first casing string, and/or a sub of the first casing string, to provide fluid communication between an outside of the first casing string and the first inter-casing annulus. The one or more of the perforating device, pyrotechnic device, explosive device, puncture device, rupture mechanism and valve in the first casing string is typically in an un-cemented section, normally externally un-cemented section. There may be cement and/or a packer above and/or below the un-cemented section.

The one or more of a perforating device, pyrotechnic device, explosive device, puncture device, rupture mechanism and valve in the first casing string may be referred to as an outer fluid flow control device.

A bottom of any inter-casing annulus may be open or more typically may be closed for example by a packer or cement barrier. References herein to cement include cement substitute. A solidifying cement substitute may include epoxies and resins, or a non-solidifying cement substitute such as Sandaband™.

The well may further comprise a transmitter, receiver or transceiver attached to one or more of the first, second and third casing strings, a well internal tubular, a production tubing, a completion tubing, and a drill pipe. When the transmitter, receiver or transceiver is attached it may be connected to one or more of the first, second and third casing strings and/or in a wall of the first, second or third casing strings. There may be many suitable forms of connection.

The one or more sensors may be physically and/or wirelessly coupled to the transmitter, receiver or transceiver. Repeaters may be provided in the well. The data may be live data and/or historical data. Data may be stored downhole for later transmission.

At least one of the one or more sensors is typically a wireless sensor. At least one of the one or more sensors is normally an acoustic and/or electromagnetic wireless sensor.

The transmitters, receivers or transceivers may communicate with each other at least partially wirelessly and/or using a wireless signal and/or wireless communication. This may be by an acoustic signal and/or electromagnetic signal and/or pressure pulse, and/or inductively coupled tubular. The wireless signal may be an acoustic and/or electromagnetic signal. The wireless signal may be referred to as wireless communication.

In use, the transmitter, receiver or transceiver may be used to recover data from the well. In use, the wireless signal may be transmitted through the well to open and/or close one or more of the outer, primary and secondary fluid flow control devices.

The wireless signal may be transmitted in at least one or more of the following forms: electromagnetic, acoustic, inductively coupled tubulars and coded pressure pulsing. References herein to "wireless" relate to said forms, unless where stated otherwise.

Pressure pulses are a way of communicating from/to within the well/borehole, from/to at least one of a further location within the well/borehole, and the surface of the well/borehole, using positive and/or negative pressure changes, and/or flow rate changes of a fluid in a tubular and/or annulus.

Coded pressure pulses are such pressure pulses where a modulation scheme has been used to encode commands within the pressure or flow rate variations and a transducer is used within the well/borehole to detect and/or generate the variations, and/or an electronic system is used within the well/borehole to encode and/or decode commands. Therefore, pressure pulses used with an in-well/borehole electronic interface are herein defined as coded pressure pulses. An advantage of coded pressure pulses, as defined herein, is that they can be sent to electronic interfaces and may provide greater data rate and/or bandwidth than pressure pulses sent to mechanical interfaces.

Where coded pressure pulses are used to transmit control signals, various modulation schemes may be used such as a pressure change or rate of pressure change, on/off keyed (OOK), pulse position modulation (PPM), pulse width modulation (PWM), frequency shift keying (FSK), pressure shift keying (PSK), and amplitude shift keying (ASK). Combinations of modulation schemes may also be used, for example, OOK-PPM-PWM. Data rates for coded pressure modulation schemes are generally low, typically less than 10 bps, and may be less than 0.1 bps.

Coded pressure pulses can be induced in static or flowing fluids and may be detected by directly or indirectly measuring changes in pressure and/or flow rate. Fluids include liquids, gasses and multiphase fluids, and may be static control fluids, and/or fluids being produced from or injected into the well.

Preferably the wireless signals are such that they are capable of passing through a barrier, such as a plug, when fixed in place. Preferably therefore the wireless signals are transmitted in at least one of the following forms: electromagnetic (EM), acoustic, and inductively coupled tubulars.

The signals may be data or control signals which need not be in the same wireless form. Accordingly, the options set out herein for different types of wireless signals are independently applicable to data and control signals. The control signals can control downhole devices, including the sensors. Data from the sensors may be transmitted in response to a control signal. Moreover, data acquisition and/or transmission parameters, such as acquisition and/or transmission rate or resolution, may be varied using suitable control signals.

EM/acoustic and coded pressure pulsing use the well, borehole or formation as the medium of transmission. The EM/acoustic or pressure signal may be sent from the well, or from the surface. If provided in the well, an EM/acoustic signal can travel through any annular sealing device, although for certain embodiments, it may travel indirectly, for example around any annular sealing device.

Electromagnetic and acoustic signals are especially preferred—they can transmit through/past an annular sealing device or barrier or annular barrier without special inductively coupled tubulars infrastructure, and for data transmission, the amount of information that can be transmitted is normally higher compared to coded pressure pulsing, especially data from the well.

The transmitter, receiver and/or transceiver used correspond with the type of wireless signals used. For example an acoustic transmitter and receiver and/or transceiver are used if acoustic signals are used.

Where inductively coupled tubulars are used, there are normally at least ten, usually many more, individual lengths of inductively coupled tubular which are joined together in use, to form a string of inductively coupled tubulars. They have an integral wire and may be formed from tubulars such as tubing, drill pipe, or casing. At each connection between adjacent lengths there is an inductive coupling. The inductively coupled tubulars that may be used can be provided by NOV under the brand Intellipipe®.

Thus, the EM/acoustic or pressure wireless signals can be conveyed a relatively long distance as wireless signals, sent for at least 200 meters, optionally more than 400 meters or longer which is a clear benefit over other shorter range signals. Embodiments including inductively coupled tubulars provide this advantage/effect by the combination of the integral wire and the inductive couplings. The distance travelled may be much longer, depending on the length of the well.

Data and/or commands within the signal may be relayed or transmitted by other means. Thus the wireless signals could be converted to other types of wireless or wired signals, and optionally relayed, by the same or by other means, such as hydraulic, electrical and fibre optic lines. In one embodiment, the signals may be transmitted through a cable for a first distance, such as over 400 meters, and then transmitted via acoustic or EM communications for a smaller distance, such as 200 meters. In another embodiment they are transmitted for 500 meters using coded pressure pulsing and then 1000 meters using a hydraulic line.

Thus whilst non-wireless means may be used to transmit the signal in addition to the wireless means, preferred configurations preferentially use wireless communication. Thus, whilst the distance travelled by the signal is dependent on the depth of the well, often the wireless signal, including relays but not including any non-wireless transmission, travel for more than 1000 meters or more than 2000 meters. Preferred embodiments also have signals transferred by wireless signals (including relays but not including non-wireless means) at least half the distance from the surface of the well to apparatus in the well including fluid flow control device(s) and one or more sensors.

Different wireless and/or wired signals may be used in the same well for communications going from the well towards the surface, and for communications going from the surface into the well.

Thus, the wireless signal may be sent directly or indirectly, for example making use of in-well relays above and/or below any sealing device or annular sealing device. The wireless signal may be sent from the surface or from a wireline/coiled tubing (or tractor) run probe at any point in the well. For certain embodiments, the probe may be positioned relatively close to any sealing device or annular sealing device for example less than 30 meters therefrom, or less than 15 meters.

Acoustic signals and communication may include transmission through vibration of the structure of the well including tubulars, casing, liner, drill pipe, drill collars, tubing, coil tubing, sucker rod, downhole tools; transmission via fluid (including through gas), including transmission through fluids in uncased sections of the well, within tubulars, and within annular spaces; transmission through static or flowing fluids; mechanical transmission through wireline, slickline or coiled rod; transmission through the earth; transmission through wellhead equipment. Communication through the structure and/or through the fluid are preferred.

Acoustic transmission may be at sub-sonic (<20 Hz), sonic (20 Hz-20 kHz), and ultrasonic frequencies (20 kHz-2 MHz). Preferably the acoustic transmission is sonic (20 Hz-20 khz).

The acoustic signals and communications may include Frequency Shift Keying (FSK) and/or Phase Shift Keying (PSK) modulation methods, and/or more advanced derivatives of these methods, such as Quadrature Phase Shift Keying (QPSK) or Quadrature Amplitude Modulation (QAM), and preferably incorporating Spread Spectrum Techniques. Typically they are adapted to automatically tune acoustic signalling frequencies and methods to suit well conditions.

The acoustic signals and communications may be uni-directional or bi-directional. Piezoelectric, moving coil transducer or magnetostrictive transducers may be used to send and/or receive the signal.

Electromagnetic (EM) (sometimes referred to as Quasi-Static (QS)) wireless communication is normally in the frequency bands of: (selected based on propagation characteristics)

sub-ELF (extremely low frequency)<3 Hz (normally above 0.01 Hz);

ELF 3 Hz to 30 Hz;

SLF (super low frequency) 30 Hz to 300 Hz;

ULF (ultra low frequency) 300 Hz to 3 kHz; and,

VLF (very low frequency) 3 kHz to 30 kHz.

An exception to the above frequencies is EM communication using the pipe as a wave guide, particularly, but not exclusively when the pipe is gas filled, in which case frequencies from 30 kHz to 30 GHz may typically be used dependent on the pipe size, the fluid in the pipe, and the range of communication. The fluid in the pipe is preferably non-conductive. U.S. Pat. No. 5,831,549 describes a telemetry system involving gigahertz transmission in a gas filled tubular waveguide.

Sub-ELF and/or ELF are preferred for communications from a well to the surface (e.g. over a distance of above 100 meters). For more local communications, for example less than 10 meters, VLF is preferred. The nomenclature used for these ranges is defined by the International Telecommunication Union (ITU).

EM communications may include transmitting communication by one or more of the following: imposing a modulated current on an elongate member and using the earth as return; transmitting current in one tubular and providing a return path in a second tubular; use of a second well as part of a current path; near-field or far-field transmission; creating a current loop within a portion of the well metalwork in order to create a potential difference between the metalwork and earth; use of spaced contacts to create an electric dipole transmitter; use of a toroidal transformer to impose current in the well metalwork; use of an insulating sub; a coil antenna to create a modulated time varying magnetic field for local or through formation transmission; transmission within the well casing; use of the elongate member and earth as a coaxial transmission line; use of a tubular as a wave guide; transmission outwith the well casing.

Especially useful is imposing a modulated current on an elongate member and using the earth as return; creating a current loop within a portion of the well metalwork in order to create a potential difference between the metalwork and earth; use of spaced contacts to create an electric dipole transmitter; and use of a toroidal transformer to impose current in the well metalwork.

To control and direct current advantageously, a number of different techniques may be used. For example one or more of: use of an insulating coating or spacers on well tubulars; selection of well control fluids or cements within or outwith tubulars to electrically conduct with or insulate tubulars; use of a toroid of high magnetic permeability to create inductance and hence an impedance; use of an insulated wire, cable or insulated elongate conductor for part of the transmission path or antenna; use of a tubular as a circular waveguide, using SHF (3 GHz to 30 GHz) and UHF (300 MHz to 3 GHz) frequency bands.

Suitable means for receiving the transmitted signal are also provided, these may include detection of a current flow; detection of a potential difference; use of a dipole antenna; use of a coil antenna; use of a toroidal transformer; use of a Hall effect or similar magnetic field detector; use of sections of the well metalwork as part of a dipole antenna.

Where the phrase "elongate member" is used, for the purposes of EM transmission, this could also mean any elongate electrical conductor including: liner; casing; tubing or tubular; coil tubing; sucker rod; wireline; drill pipe; slickline or coiled rod.

A means to communicate signals within a well with electrically conductive casing is disclosed in U.S. Pat. No. 5,394,141 by Soulier and U.S. Pat. No. 5,576,703 by MacLeod et al both of which are incorporated herein by reference in their entirety. A transmitter comprising oscillator and power amplifier is connected to spaced contacts at a first location inside the finite resistivity casing to form an electric dipole due to the potential difference created by the current flowing between the contacts as a primary load for the power amplifier. This potential difference creates an electric field external to the dipole which can be detected by either a second pair of spaced contacts and amplifier at a second location due to resulting current flow in the casing or alternatively at the surface between a wellhead and an earth reference electrode.

A relay comprises a transceiver (or receiver) which can receive a signal, and an amplifier which amplifies the signal for the transceiver (or a transmitter) to transmit it onwards.

The well typically includes multiple components, including the fluid flow control device(s) and one or more sensors and/or wireless communication devices. Any of the components of the well may be referred to as well apparatus.

There may be at least one relay. The at least one relay (and the transceivers or transmitters associated with the well or at the surface) may be operable to transmit a signal for at least 200 meters through the well. One or more relays may be configured to transmit for over 300 meters, or over 400 meters.

For acoustic communication there may be more than five, or more than ten relays, depending on the depth of the well and the position of well apparatus.

Generally, less relays are required for EM communications. For example, there may be only a single relay. Optionally therefore, an EM relay (and the transceivers or transmitters associated with the well or at the surface) may be configured to transmit for over 500 meters, or over 1000 meters.

The transmission may be more inhibited in some areas of the well, for example when transmitting across a packer. In this case, the relayed signal may travel a shorter distance. However, where a plurality of acoustic relays are provided, preferably at least three are operable to transmit a signal for at least 200 meters through the well.

For inductively coupled tubulars, a relay may also be provided, for example every 300-500 meters in the well.

The relays may keep at least a proportion of the data for later retrieval in a suitable memory means.

Taking these factors into account, and also the nature of the well, the relays can therefore be spaced apart accordingly in the well.

The control signals may cause, in effect, immediate activation, or may be configured to activate the well apparatus after a time delay, and/or if other conditions are present such as a particular pressure change.

At least one of the primary and secondary fluid flow control devices, and/or one or more of the sensors, is normally electrically powered, typically by a downhole power source. At least one of the primary and secondary control devices and/or one or more of the sensors may be battery powered. At least one of a transmitter, receiver or transceiver attached to one or more of the first, second and third casing strings, a well internal tubular, a production tubing, a completion tubing, and a drill pipe is normally battery powered.

The well apparatus may comprise at least one battery optionally a rechargeable battery. Each device/element of the well apparatus may have its own battery, optionally a rechargeable battery. The battery may be at least one of a high temperature battery, a lithium battery, a lithium oxyhalide battery, a lithium thionyl chloride battery, a lithium sulphuryl chloride battery, a lithium carbon-monofluoride battery, a lithium manganese dioxide battery, a lithium ion battery, a lithium alloy battery, a sodium battery, and a sodium alloy battery. High temperature batteries are those operable above 85° C. and sometimes above 100° C. The battery system may include a first battery and further reserve batteries which are enabled after an extended time in the well. Reserve batteries may comprise a battery where the electrolyte is retained in a reservoir and is combined with the anode and/or cathode when a voltage or usage threshold on the active battery is reached.

The battery and optionally elements of control electronics may be replaceable without removing tubulars. They may be replaced by, for example, using wireline or coiled tubing. The battery may be situated in a side pocket.

The battery typically powers components of the well apparatus, for example a multi-purpose controller, a monitoring mechanism and a transceiver. Often a separate battery is provided for each powered component. In alternative embodiments, downhole power generation may be used, for example, by thermoelectric generation.

The well apparatus may comprise a microprocessor. Electronics in the well apparatus, to power various components such as the microprocessor, control and communication systems, and optionally the valve, are preferably low power electronics. Low power electronics can incorporate features such as low voltage microcontrollers, and the use of 'sleep' modes where the majority of the electronic systems are powered off and a low frequency oscillator, such as a 10-100 kHz, for example 32 kHz, oscillator used to maintain system timing and 'wake-up' functions. Synchronised short range wireless (for example EM in the VLF range) communication techniques can be used between different components of the system to minimize the time that individual components need to be kept 'awake', and hence maximise 'sleep' time and power saving.

The low power electronics facilitates long term use of various components. The electronics may be configured to be controllable by a control signal up to more than 24 hours after being run into the well, optionally more than 7 days, more than 1 month, or more than 1 year or up to 5 years. It can be configured to remain dormant before and/or after being activated.

It may not be possible to collect downhole data at a surface location, on for example a rig or platform, associated with a blown-out well. A transponder or transponders may therefore be deployed into the sea from a vessel nearby and signals sent to the transponder(s) on or adjacent to a subsea structure of the blown-out well. If for any reason these are damaged or have been destroyed in the blow-out, additional transponders can be retrofitted at any time.

By retrieving data, particularly data from the one or more sensors, the condition of the well may be evaluated and an operator may be able to safely design and/or adapt a method of controlling the well. In addition, density and/or volume of the fluid required to control/kill the well may be more accurately calculated.

A fluid flow control device in an outer casing string may be opened and then closed again before a fluid flow control device in an inner casing string or inner string is opened, but the fluid flow control devices may be opened simultaneously to allow the flow of fluid between annuli, casing bores and/or a production tubing or other inner string. The first casing string may not be the outermost casing string. The casing string(s) may be referred to and/or comprise a liner(s). The casing string(s) may not extend to the top of the well and/or the surface. There may be a further casing string(s) of a larger diameter and therefore typically outside the first casing string.

The outer, primary and/or secondary fluid flow control device is typically a valve. The valve is typically a check valve. There may be more than one outer, primary and/or secondary fluid flow control device on the respective string.

When the outer, primary and/or secondary fluid flow control device is a valve, the valve may have a valve member. The valve and/or valve member is typically moveable from a first closed position to a second open position. Optionally the valve and/or valve member can move to a further closed position or back to the first closed position. The valve may comprise more than one valve member.

The valve and/or valve member may be moveable to a check position, that may be a position between a closed position and an open position. The valve may only allow fluid flow in one direction, that is normally one or more of into the first casing annulus; from the first inter-casing annulus into the second inter-casing annulus; and/or from the second inter-casing annulus into the third casing bore. The valve may resist fluid flow in one direction, that is normally one or more of out of the first casing annulus; from the second casing bore into the first inter-casing annulus; and/or from the third casing bore into the second inter-casing annulus. The valve may allow fluid flow in both directions.

The primary, secondary and/or outer fluid flow control device may comprise a valve, casing valve or rupture mechanism. The rupture mechanisms referred to above and below may comprise one or more of a rupture disk, pressure activated piston and a pyrotechnic device. The pressure activated piston may be retainable by a shear pin.

The rupture mechanism may be designed to preferentially rupture in response to fluid pressure from one side, typically an outer side. For the primary fluid flow control device the rupture mechanism may only rupture in response to fluid pressure in the first inter-casing annulus. For the secondary fluid flow control device the rupture mechanism may only rupture in response to fluid pressure in the second inter-casing annulus. For the outer fluid flow control device the rupture mechanism may only rupture in response to fluid pressure outside the first casing string.

The well may further comprise a rupture mechanism in the first casing string. Pressurising fluid on an outside of the first casing string may cause the rupture mechanism in the first casing string to rupture, thereby initiating fluid flow into the first inter-casing annulus.

When the primary, secondary and/or outer fluid flow control device is in an open position, it typically has a cross-sectional fluid flow area of at least 100 $mm^2$, normally at least 200 $mm^2$, and may be 400 $mm^2$.

The primary, secondary and/or outer fluid flow control device may comprise a plurality of apertures. When the primary, secondary and/or outer fluid flow control device comprises a plurality of apertures, the plurality of apertures typically have a total cross-sectional fluid flow area of at least 100 $mm^2$, normally at least 200 $mm^2$, and may be 400 $mm^2$.

The well is often an at least partially vertical well. Nevertheless, it can be a deviated or horizontal well. References such as "above" and "below" when applied to deviated or horizontal wells should be construed as their equivalent in wells with some vertical orientation. For example, "above" is closer to the surface of the well.

The well described herein is typically a naturally flowing well, that is fluid naturally flows up the well to surface, and/or fluid flows to the surface unassisted or unaided.

According to a second aspect of the present invention, there is provided a method of fluid management using the well described above and in particular a well comprising:

- a first, a second and a third casing string, the second casing string at least partially inside the first casing string, the third casing string at least partially inside the second casing string;
- the first and second casing strings defining a first inter-casing annulus therebetween, the second and third casing strings defining a second inter-casing annulus therebetween, the third casing string defining a third casing bore therewithin;
- a primary fluid flow control device in the second casing string to provide fluid communication between the first inter-casing annulus and the second inter-casing annulus; and
- a secondary fluid flow control device in the third casing string to provide fluid communication between the second inter-casing annulus and the third casing bore.

The method may include the steps of introducing a fluid into the first inter-casing annulus; opening the primary fluid flow control device; and directing the fluid between the first and the second inter-casing annulus. The method may include the steps of opening the secondary fluid flow control device; and directing the fluid between the second inter-casing annulus and the third casing bore.

When the well further comprises a fluid port in the first inter-casing annulus, the method typically includes the step of introducing a fluid into the first inter-casing annulus through the fluid port.

When the well further comprises a fluid port in the second inter-casing annulus, the method normally includes the step of introducing a fluid into the second inter-casing annulus through the fluid port.

When the well further comprises one or more sensors at, in or on one or more of a face of the geological structure, the well, an annulus, a casing bore, a production string, a completion string, and a drill string, the method typically includes the step of collecting data from the one or more sensors to monitor the well at least periodically for a period of years.

The well structure comprising the primary and secondary fluid flow control devices may be used for fluid management and/or may be used for changing the fluid in the first inter-casing annulus and/or the second inter-casing annulus and/or third casing bore to manage well integrity.

Managing well integrity may include introducing fluids to mitigate leaks to or from the first inter-casing annulus and/or the second inter-casing annulus and/or the third casing bore. Managing well integrity may include introducing fluids into first inter-casing annulus and/or the second inter-casing annulus and/or the third casing bore, for instance to control corrosion. The fluids may comprise a chemical, such as a chemical to remove and/or dissolve material in the well, such as a blockage or restriction. Managing well integrity may include introducing cement into first inter-casing annulus and/or the second inter-casing annulus and/or third casing bore. It may be an advantage of the present invention that the method of fluid management and so also managing well integrity may reduce the need for early well work over. Managing well integrity may include one or more of controlling, partially killing and killing the well.

The method of fluid management may be used to maintain control and/or manipulate the pressure conditions in the well. Maintaining, controlling and/or manipulating of the pressure conditions in the well may involve one or more of increasing, decreasing and keeping the said conditions substantially constant. Examples of the pressure conditions comprise the hydrostatic pressure in the well, the density of the fluids in the well, or the flow rate of the fluids in the well.

When drilling, the pressure in the well, especially the hydrostatic pressure at the bottom of the well is normally maintained above the reservoir pressure, to assist in well control and inhibit fluids escaping from the top of the well whilst drilling i.e. to resist 'blowing out'.

Nevertheless, this may lead to several problems, especially in very deep wells with larger hydrostatic heads. For example, it may lead to differential sticking of the drill pipe to the wellbore wall, or it may cause loss of the drilling mud into the formation, which wastes drilling fluid, may in turn damage the fractures therein or indeed can inadvertently lose pressure control of the well.

An alternative is for the hydrostatic pressure to be deliberately lowered in a section of the well, for example, by injecting lighter fluid, typically gas, into the drilling mud. This reduces the density of the overall fluid mixture in that section, whilst the well pressure is controlled by higher density drilling fluid in other sections of the well.

The inventors of the present invention recognise that the well and method of fluid management provide an alternative path through which fluids for such drilling can be injected through the flow control devices into the well in a controlled manner, thereby allowing for a more effective management of well integrity.

Thus, fluid may be directed through a flow control device whilst drilling.

The outer, primary and/or secondary fluid flow control device is typically a valve as described for the first aspect of the invention. The optional features of the fluid flow control device described hereinabove are also optional features for the second aspect of the invention, and not repeated for brevity.

The method of fluid management may be particularly useful for a subsea well.

Features and optional features of the second aspect of the present invention may be incorporated into the first aspect of the present invention and vice versa and are not repeated here for brevity.

DETAILED DESCRIPTION

Figure 2:
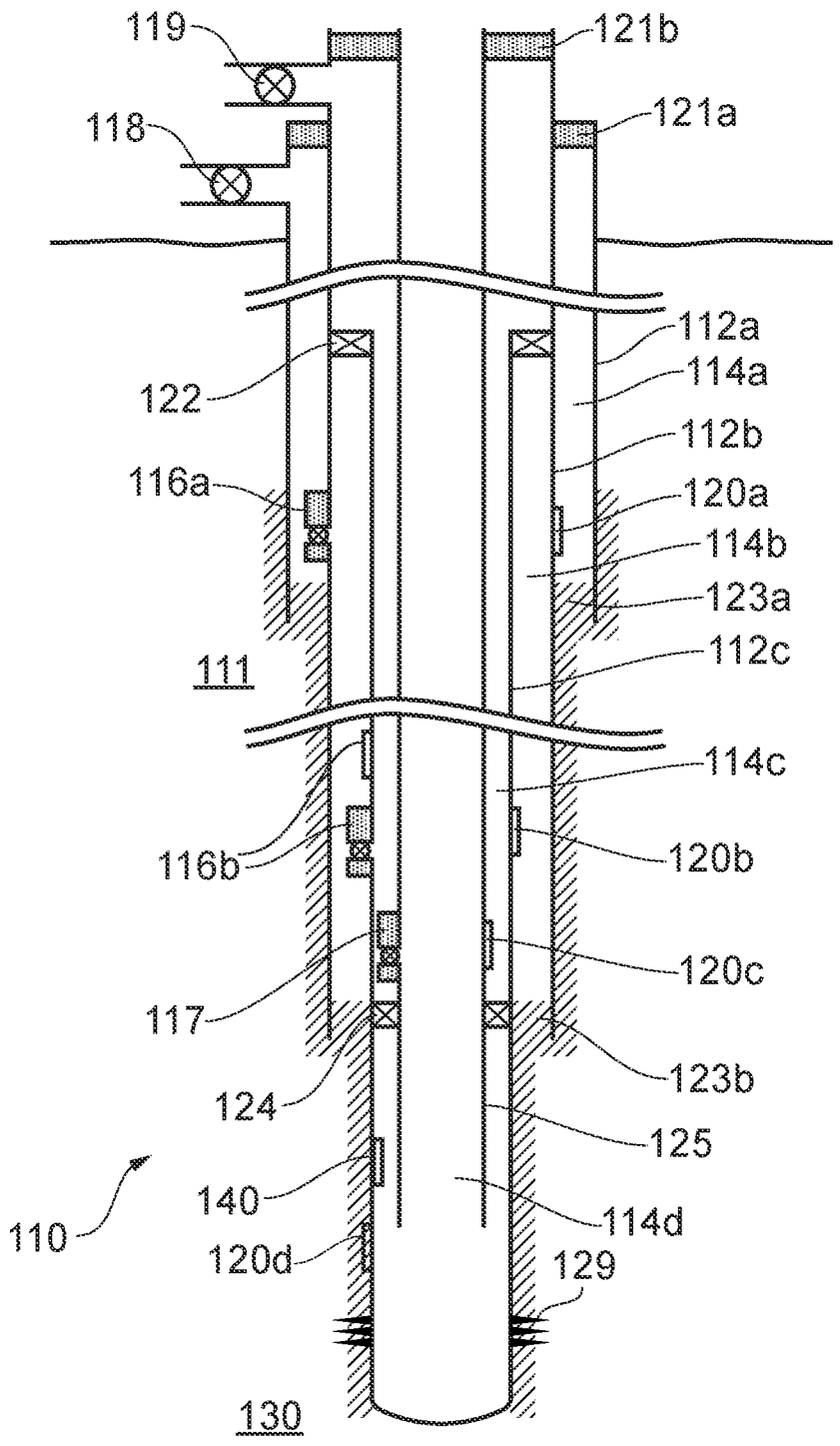

Embodiments of the present invention will now be described, by way of example only, with reference to the accompanying drawings, in which:

FIG. 1 is a cross-sectional view of an open hole well during construction; and FIG. 2 is a cross-sectional view of a completed well.

FIG. 1 shows a well 10 in a geological structure 11. The well 10 has a first 12*a*, a second 12*b* and a third 12*c* casing string. The second casing string 12*b* is at least partially inside the first casing string 12*a*, and the third casing string 12*c* is at least partially inside the second casing string 12*b*. The first 12*a* and second 12*b* casing strings define a first inter-casing annulus 14*a* therebetween. The second 12*b* and third 12*c* casing strings define a second inter-casing annulus 14*b* therebetween. The third casing string 12*c* defines a third casing bore 14*c* therewithin.

A primary fluid flow control device 16*a* in the second casing string 12*b* provides fluid communication between the first inter-casing annulus 14*a* and the second inter-casing annulus 14*b*. A secondary fluid flow control device 16*b* in the third casing string 12*c* provides fluid communication between the second inter-casing annulus 14*b* and the third casing bore 14*c*.

A fluid (not shown) is introduced into the first inter-casing annulus 14*a* through a fluid port 18. The primary fluid flow control device 16*a* is then opened and the fluid (not shown) directed between the first inter-casing annulus 14*a* and the second inter-casing annulus 14*b*. The secondary fluid flow control device 16*b* is then opened and the fluid (not shown) directed between the second inter-casing annulus 14*b* and the third casing bore 14*c*.

The fluid has not been shown in any of the figures so as not to over-complicate the drawings.

The primary 16*a* and secondary 16*b* fluid flow control devices comprise a valve and a rupture mechanism.

FIG. 1 shows the well 10 comprising a series of casing strings 12*a*, 12*b*, 12*c* defining a series of inter-casing annuli 14*a* and 14*b* and a casing bore 14*c*. The first inter-casing annulus 14*a* is also referred to as the "C" annulus. The second inter-casing annulus 14*b* is also referred to as the "B" annulus. FIG. 1 does not show an "A" annulus.

The fluid, in this case a drilling mud (not shown), is sealed in the first inter-casing annulus 14*a*, at the top by a casing hanger 21*a* and at the bottom by cement 23*a*. The drilling mud (not shown) is sealed in the second inter-casing annulus 14*b*, at the top by a packer 22 and at the bottom by cement 23*b*. The third casing string 12*c* may be referred to as a liner.

The second casing string 12*b* has sensors 20*a* to measure fluid pressure and density in the first inter-casing annulus 14*a*. The third casing string 12*c* has sensors 20*b* to measure fluid pressure and density in the second inter-casing annulus 14*b*. Data from the sensors 20*a*, 20*b*, is used to optimise properties of the fluid that is directed between the annuli and casing bore 14*a*, 14*b* and 14*c*. Additionally, the sensors 20*a* on the second casing string 12*b* may be ported to measure fluid pressure and density in the first inter-casing annulus 14*a* and the second inter-casing annulus 14*b*. The sensors 20*b* on the third casing string 12*c* may be ported to measure fluid pressure and density in the second inter-casing annulus 14*b* and the third casing bore 14*c*.

Using the sensors 20*a* the pressure and density of the fluid in the first inter-casing annulus 14*a* and second inter-casing annulus 14*b* are measured before opening the primary fluid flow control device 16*a* and directing the fluid from the first inter-casing annulus 14*a* into the second inter-casing annulus 14*b*. Using the sensors 20*b*, the pressure and density of the fluid in the second inter-casing annulus 14*b* and third casing bore 14*c* are measured before opening the secondary fluid flow control device 16*b* and directing the fluid from the second inter-casing annulus 14*b* into the third casing bore 14*c*.

A wireless electromagnetic signal is transmitted through the well 10 to open the primary fluid flow control device 16*a* and direct the fluid between the first inter-casing annulus 14*a* and the second inter-casing annulus 14*b*. A wireless electromagnetic signal is transmitted through the well 10 to open the secondary fluid flow control device 16*b* and direct the fluid between the second inter-casing annulus 14*b* and the third casing bore 14*c*. Alternatively the wireless signal is an acoustic wireless signal.

In an open position, the primary fluid flow control device 16*a* and the secondary fluid flow control device 16*b* each have a cross-sectional fluid flow area of more than 100 $mm^2$.

The sensors 20*a* and 20*b* are coupled to acoustic transceivers (not shown). The sensors 20*a* and 20*b* measure the temperature, pressure and density of the fluid. Alternatively, the sensors are coupled to electromagnetic transceivers.

In the event that the well 10 has blown-out and become damaged and cannot be managed using conventional means, the sensors 20*a* and 20*b* can, using acoustic transmission, be used to provide an accurate idea of the integrity of the well downhole. For example, some of the casing strings may be breached and it is not always apparent from the surface what the fluid path of escaping hydrocarbons is.

It may be an advantage of the present invention that access and fluid control into and/or between the first and second inter-casing annulus has now been made possible by use of the first and second fluid flow control device. Conventionally, these annuli are sealed top and bottom and circulation into the third-casing bore through these annuli is not possible.

FIG. 1 shows a casing bore 14*c* that can be managed and control regained by flowing fluid in a cascade from the outside of the well to the inside, through the fluid port 18 into the first inter-casing annulus 14*a*, through the primary fluid flow control device 16*a* into the second inter-casing annulus 14*b*, and through the secondary fluid flow control device 16*b* into the third casing bore 14*c*.

Up-to-date data can be collected from the sensors 20*a* and 20*b* which provide information on the conditions in the C and B annuli, casing bore 14*c*. If the downhole conditions are monitored, usually via wireless data collection, the drilling mud density and volume required to be pumped into the well/formation(s), can be calculated to avoid the possibility of causing a subterranean blow-out by rupturing the casing string and surrounding formation(s).

In this embodiment we have the option to reclose the inter-casing valves 16*a* and 16*b* to maintain the integrity of the casing strings 12*b* and 12*c*.

Embodiments of the present invention provide a feedback system which allows better management of a hazardous control and/or kill procedure, because it is based on sensor readings rather than estimates of for example the well pressure. Moreover, monitoring can continue as the well is being controlled and/or killed, so that the control/kill procedure is adjusted and optimised according to the information being received.

It may be an advantage of the present invention that the well provides for significantly quicker control of a well compared to known methods, such as re-entering a well by capping and installing a new well internal tubular. The saving may be several days, weeks or even months, reducing the potential damage to the surrounding environment as well as saving a very significant amount of time and money.

Fluid port 16*b* is lower and deeper in the well than fluid port 16*a*. In an alternative embodiment the fluid port 16*a* is lower and deeper, or they are disposed at a similar depth in the well. Open hole wells provide a fluid communication path with the formation.

Internal tubulars (not shown in FIG. 1) may be present, such as a drill string. The well 10 is shown in FIG. 1 as open-hole.

Features of the well shown in FIG. 1 that are also shown in FIG. 2 have been given the same reference number with a prefix 1, so the first casing string is 12*a* in FIGS. 1 and 112*a* in FIG. 2. Other well control structures may be present that are not shown.

FIG. 2 also shows an inner string, in this embodiment a tubular 125 in the well 110, the tubular 125 defining an inner bore 114*d* therewithin. There is an inner valve 117 in the tubular 125 that provides fluid communication between the third annulus 114*c* and the inner bore 114*d*. The third annulus 114*c* is the casing bore, also referred to as the A-annulus.

FIG. 2 shows a well 110 in a geological structure. The well 110 has a first 112*a*, a second 112*b* and a third 112*c* casing string. The second casing string 112*b* is at least partially inside the first casing string 112*a*, and the third casing string 112*c* is at least partially inside the second casing string 112*b*. The first 112*a* and second 112*b* casing strings define a first inter-casing annulus 114*a* therebetween. The second 112*b* and third 112*c* casing strings define a second inter-casing annulus 114*b* therebetween. The third casing string 112*c* and tubular 125 define a third annulus 114*c*.

The inner string 125 has a sensor 120*c* to measure fluid pressure and density in the annulus 114*c*. Data from the sensors 120*a*, 120*b* and 120*c* are used to optimise properties of the fluid that is directed between the annuli 114*a*, 114*b* and 114*c*.

The fluid, in this case a drilling mud (not shown), is sealed in the first inter-casing annulus 114*a*, at the top by a casing hanger 121*a* and at the bottom by cement 123*a*. The drilling mud (not shown) is sealed in the second inter-casing annulus 114*b* at the top by a packer 122 and at the bottom by cement 123*b*. The drilling mud (not shown) is sealed in the third annulus 114*c* by a packer 124 at the bottom of the annulus and liner hanger 121*b* at the top of the annulus.

FIG. 2 shows a well 110 in which fluid flow can be managed and control regained by flowing fluid in a cascade from the outside of the well to the inside, through the fluid port 118 into the first inter-casing annulus 114*a*, through the primary fluid flow control device 116*a* into the second inter-casing annulus 114*b*, and through the secondary fluid flow control device 116*b* into the third casing bore 114*c*. Fluid can also be flowed through the fluid port 119 into the third casing bore 114*c* and through the inner valve 117 into inner bore 114*d*. The inner valve 117 may be referred to as a fluid port and/or may be used similarly to fluid port 119 to provide fluid communication with the third casing bore 114*c*.

The geological structure 111 comprises a reservoir 130 that contains hydrocarbons (not shown). There is an uppermost communication path 129, that is the communication path that is closest to surface (at the top of FIG. 2).

The communication path 129 is a perforation created in the well and surrounding reservoir 130 by a perforating gun. The inner valve 117, also referred to as the inner fluid flow control device, is within 1000 meters from the uppermost communication path 129 of the well 110.

Fluid can be flowed into the well through fluid port 118. Fluid can be flowed into the well through fluid port 118, circulated through the well and back out of the well through fluid port 119. Fluid can be flowed into the well through fluid port 119. Fluid can be flowed into the well through fluid port 119, circulated through the well and back out of the well through fluid port 118. Fluid can be flowed into the well through fluid port 118 and circulated through inner bore 114*d*. Fluid can be flowed into the well through inner bore 114*d* and circulated through the well and back out of the well through fluid port 118. Thus, fluids in the well can be managed and the well controlled.

In alternative embodiments the inner string may be any other tubular string, such as a drill string, a completion string, a production string, a test string, drill stem test (DST) string, a further casing string and liner.

Devices such as fluid control devices and sensors associated with strings, such as casing strings, tubing strings, production strings, drilling strings, may be associated with a sub-component of the string such as tubular joints, subs, carriers, packers, cross-overs, clamps, pup joints, and collars, etc.

Improvements and modifications may be incorporated herein without departing from the scope of the invention.

That claimed is:

1. A well in a geological structure, the well comprising:

a first, a second and a third casing string, the second casing string at least partially inside the first casing string, the third casing string at least partially inside the second casing string;

the first and second casing strings defining a first inter-casing annulus therebetween, the second and third casing strings defining a second inter-casing annulus therebetween, the third casing string defining a third casing bore therewithin;

a primary fluid flow control device in the second casing string to direct a fluid introduced into the first inter-casing annulus to the second inter-casing annulus; and a secondary fluid flow control device in the third casing string to direct the fluid from the second inter-casing annulus to the third casing bore, and wherein, in an open position, each of the primary and the secondary fluid flow control devices have a cross-sectional fluid flow area of at least 100 $mm^2$.

2. A well according to claim 1, wherein at least one of the primary and secondary fluid flow control devices comprises a valve.

3. A well according to claim 2, wherein the valve of at least one of the primary and secondary fluid flow control devices is a wirelessly controllable valve.

4. A well according to claim 2, wherein the valve of at least one of the primary and secondary fluid flow control devices is at least one of an acoustic and electromagnetic wirelessly controllable valve.

5. A well according to claim 1, wherein at least one of the primary and secondary fluid flow control devices comprises a rupture mechanism.

6. A well according to claim 1, wherein at least one of the primary and secondary fluid flow control devices comprises a check valve.

7. A well according to claim 1, wherein at least one of the primary and secondary fluid flow control devices includes a metal to metal seal.

8. A well according to claim 1, the well further comprising one or more sensors at, in or on one or more of a face of the geological structure, the well, an annulus, a casing bore, a casing string, a production string, a completion string, and a drill string.

9. A well according to claim 8, wherein at least one of the one or more sensors is a wireless sensor.

10. A well according to claim 9, wherein at least one of the one or more sensors is an acoustic and/or electromagnetic wireless sensor.

11. A well according to claim 8, wherein at least one of the one or more sensors is electrically powered.

12. A well according to claim 1, wherein the primary fluid flow control device is within 1000 meters of an uppermost communication path of the well.

13. A well according to claim 1, wherein the secondary fluid flow control device is within 1000 meters of an uppermost communication path of the well.

14. A well according to claim 1, wherein at least one of the primary and secondary fluid flow control devices is electrically powered.

15. A well according to claim 1, wherein at least one of a transmitter, receiver or transceiver attached to one or more of the first, second and third casing strings, a well internal tubular, a production tubing, a completion tubing, and a drill pipe is electrically powered.

16. A well according to claim 1, wherein the second inter-casing annulus is not ported at the top of the well.

17. A well according to claim 1, wherein the third casing string does not extend to the top of the well.

18. A well according to claim 1, the well comprising two fluid flow control devices on one casing string.

19. A well according to claim 18, the well comprising an annular sealing device between the two fluid flow control devices on one casing string.

20. A well according to claim 19, wherein the annular sealing device is wirelessly controllable.

21. A well according to claim 20, wherein the annular sealing device is one or more of acoustically and electromagnetically wirelessly controllable.

22. A well according to claim 19, wherein the annular sealing device is one or more of settable and unsettable multiple times.

23. A method of fluid management utilizing the well according to claim 1, the method including the steps of introducing a fluid into the first inter-casing annulus, opening the primary fluid flow control device, and directing the fluid from the first to the second inter-casing annulus.

24. A method of fluid management according to claim 23, the method including the steps of opening the secondary fluid flow control device; and directing the fluid from the second inter-casing annulus to the third casing bore.

25. A method of fluid management according to claim 23, wherein the well further comprises a fluid port in the first inter-casing annulus, the method including the step of introducing, or releasing a fluid into, or from, the first inter-casing annulus through the fluid port.

26. A method of fluid management according to claim 23, wherein the well further comprises a fluid port in the third casing bore, the method including the step of introducing, or releasing a fluid into, or from, the third casing bore through the fluid port in the third casing bore.

27. A method of fluid management according to claim 23, wherein the well further comprises one or more sensors at, in or on one or more of a face of the geological structure, the well, an annulus, a casing bore, a casing string, a production string, a completion string, and a drill string and the method includes the step of collecting data from the one or more sensors to monitor the well at least periodically for a period of years.

28. A method as claimed in claim 23, comprising directing fluids through at least one of the primary and secondary fluid flow control devices whilst drilling.

* * * * *